United States Patent [19]

Acker

[11] Patent Number: 4,463,745

[45] Date of Patent: Aug. 7, 1984

[54] DEVICE FOR LAUNCHING A PROJECTILE

[75] Inventor: Josef Acker, Seligenstadt, Fed. Rep. of Germany

[73] Assignee: Jacob Acker & Sohne, Fed. Rep. of Germany

[21] Appl. No.: 282,060

[22] Filed: Jul. 10, 1981

Related U.S. Application Data

[63] Continuation of Ser. No. 23,903, Mar. 26, 1979, abandoned.

[30] Foreign Application Priority Data

Mar. 31, 1978 [DE] Fed. Rep. of Germany ..... 2813840

[51] Int. Cl.[3] ..... F41B 15/00

[52] U.S. Cl. ..... 124/6; 124/41 R; 124/49

[58] Field of Search ..... 124/6; 221/107, 108; 124/6, 8, 9, 27, 29, 41 R, 49, 50

[56] References Cited

U.S. PATENT DOCUMENTS 1,201,626 10/1916 Reynolds .

FOREIGN PATENT DOCUMENTS 859925 6/1939 France .
470201 5/1936 United Kingdom .
984066 11/1963 United Kingdom .

*Primary Examiner*—Richard J. Apley
*Assistant Examiner*—S. R. Crow
*Attorney, Agent, or Firm*—Roberts, Spiecens & Cohen

[57] ABSTRACT

The invention relates to a device for ejecting a projectile having a rotatably driven carrier on which at least one radially arranged guide tube is attached and into which a feed path by means of a release device delivers close to the rotational axis of the carrier projectiles to be ejected. The device rotates at at least 100 rpm and the guide tube is at least 0.1 m in length.

17 Claims, 15 Drawing Figures

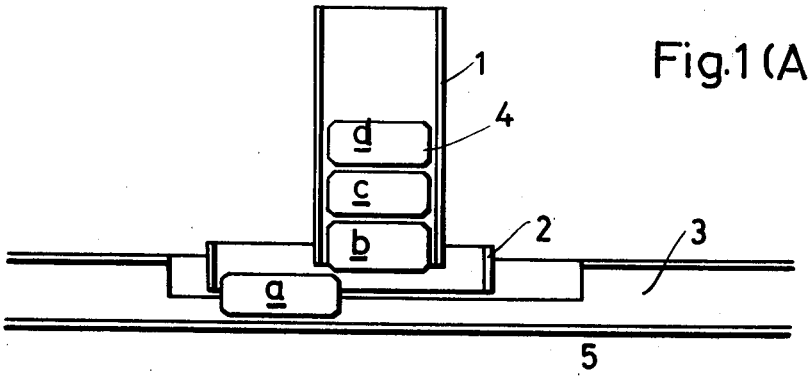
Fig.1 (A-A)
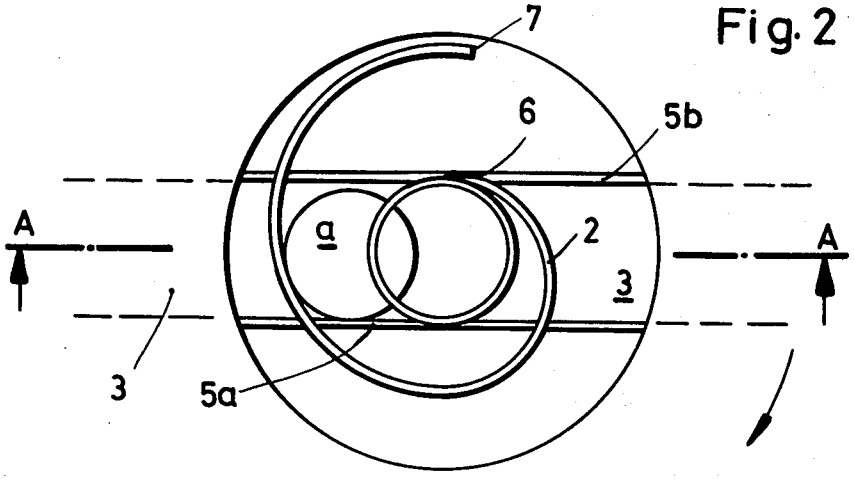
Fig. 2
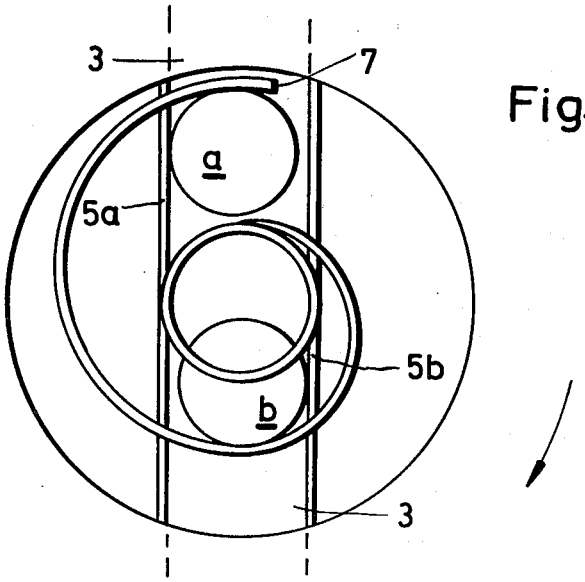
Fig.3

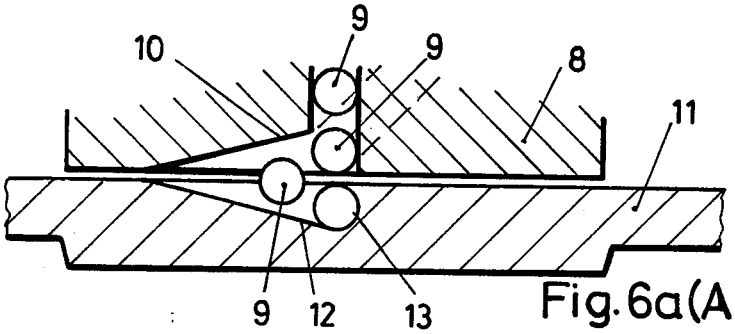
Fig.6a(A-A)
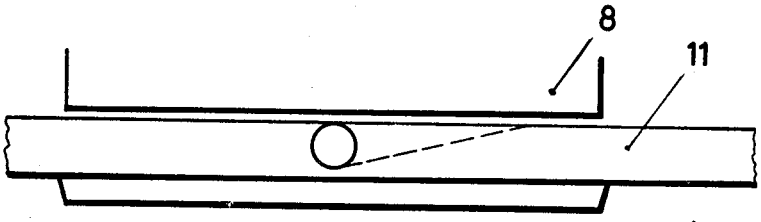
Fig.6b(B-B)
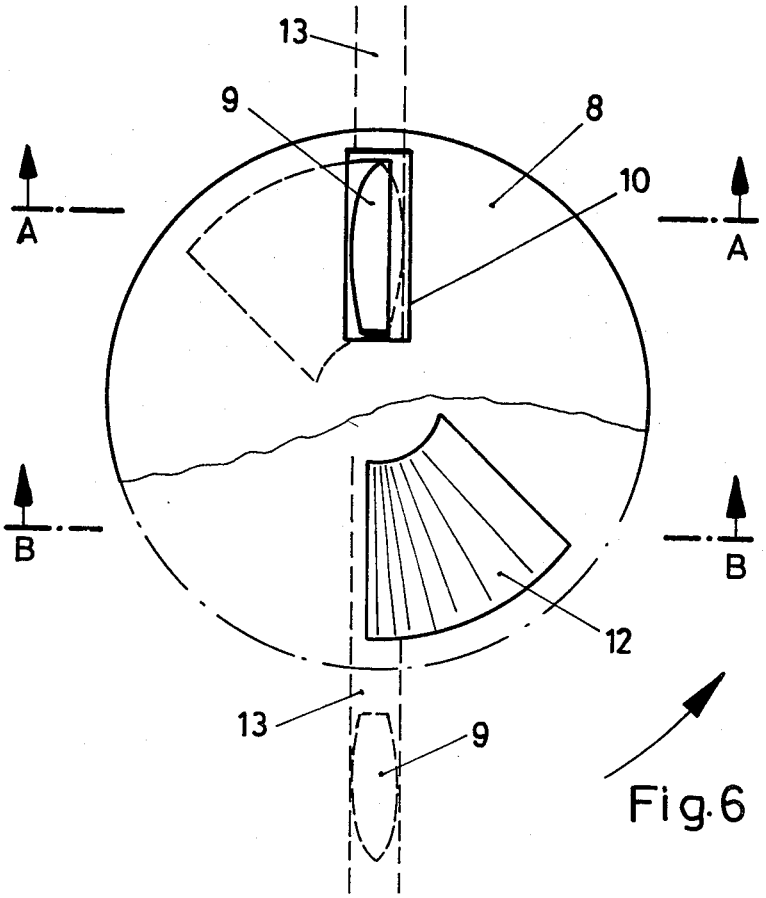
Fig.6

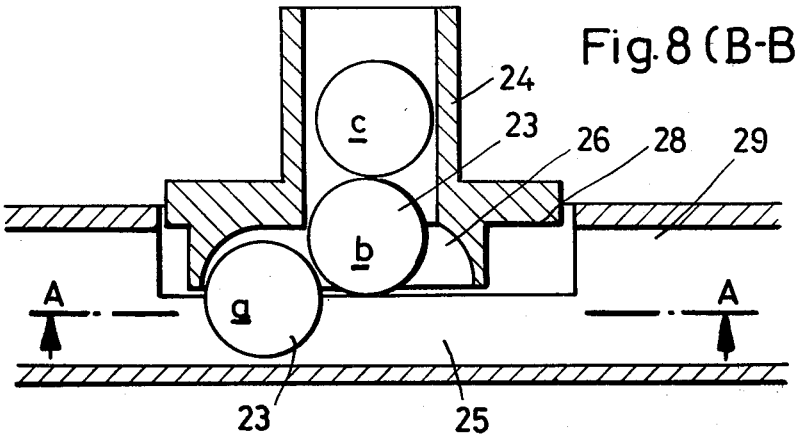
Fig.8 (B-B)
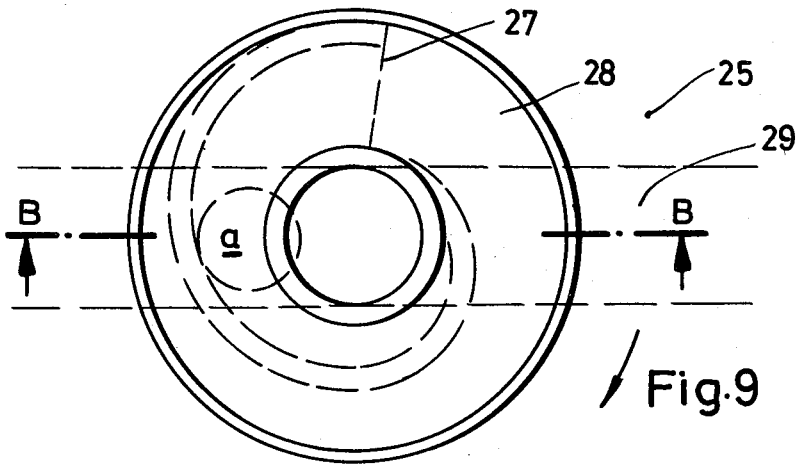
Fig.9
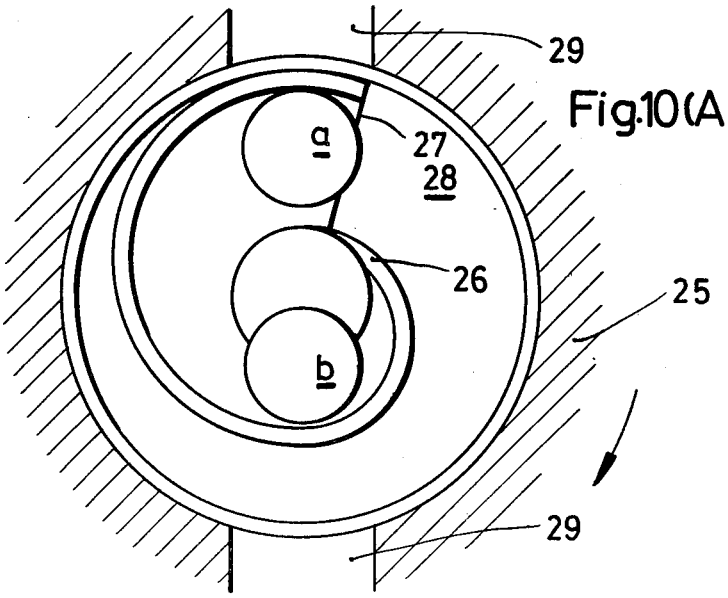
Fig.10(A-A)

DEVICE FOR LAUNCHING A PROJECTILE

This is a continuation of application Ser. No. 23,903, filed Mar. 26, 1979, abandoned Oct. 28, 1981.

BACKGROUND OF THE INVENTION

This invention pertains to weaponry and more particularly to centrifugal devices for launching projectiles.

The art of weapons has from its very start been familiar with the propulsion of projectiles by catapults. In the course of time, many methods were developed of loading and cocking or, in the case of rotating launchers, in stopping and restarting after each shot. Entirely aside from this, propulsion problems were not solved in earlier times in the same way as today. In the case of rotating launchers one of the most important problems was the directed or somewhat directed ejection of the projectile. There is known a modern launcher according to German application P 26 60 074.8 15, filed Oct. 28, 1976 and published Aug. 31, 1978.

SUMMARY OF THE INVENTION

One object of the present invention is to provide a rotary launcher so that projectiles can be ejected with a high initial velocity and/or high weight.

The present invention proceeds from a device for the launching of a projectile consisting of a carrier driven in rotary movement which has at least one radially extending guide tube for the projectile into which, approximately at the axis of rotation of the carrier, enters a feed guide for the projectiles. The guide in its turn contains a release device which is connected with a second undriven carrier. The speed of rotation of the driven carrier is, in accordance with the invention, made equal to at least 100 rpm and the length of the guide tubes is equal to at least 0.1 m.

BRIEF DESCRIPTION OF THE DRAWING

Details and further developments of the inventive concept will be described in further detail in the following specification when read with the accompanying drawing which shows by way of example the presently preferred embodiment of the invention. In the drawing:

FIG. 1 shows, merely diagrammatically, a longitudinal section along the line B—B of FIG. 2 through a first embodiment of the invention;

FIGS. 2 to 5 are top views of the embodiment shown in FIG. 1, in different operating positions;

FIG. 6 is a top view of a second embodiment of the invention;

FIG. 6*a* is a sectional view along the line A—A of FIG. 6;

FIG. 6*b* is a sectional view along the line B—B of FIG. 6;

FIG. 8 is a longitudinal section through a further embodiment of the invention;

FIG. 9 is a top view of the embodiment of FIG. 8;

FIG. 10 is a sectional view along the line B—B of FIG. 9;

DESCRIPTION OF THE PREFERRED EMBODIMENTS

With the devices described below it is possible to launch projectiles in a continuous and aimed fashion. The essential advance in the art is the introduction of the projectiles through the axis or in the vicinity of the axis of the device. Because of this it is possible to fire with a high apparent rate never before achieved. One projectile can be launched per tube per revolution.

The feeds or barriers serve to guide the projectiles with minimum centrifugal force in such a manner that they enter the launching tube properly aimed at the end of the barrier. They are displaceable for aiming and depending upon their adjustment, permit the entrance of one projectile per tube per revolution at the same place into the launching tube, whereby a properly aimed launch is made possible. Since the projectiles still have no particular force against the barrier, the introduction is relatively easy and is possible up to the highest speeds of rotation.

The actual development of force takes place after leaving of the barrier and acceleration in the launching tube up to the desired muzzle velocity.

Here the Coriolis acceleration and the Coriolis force take place. The centrifugal force which occurs results from the product of acceleration and mass, corresponding to the muzzle energy, such as produced for firearms with linear movement.

From the centrifugal acceleration and centrifugal force there result higher muzzle velocities than are to be expected on basis of the circumferential speed.

Figure 11:
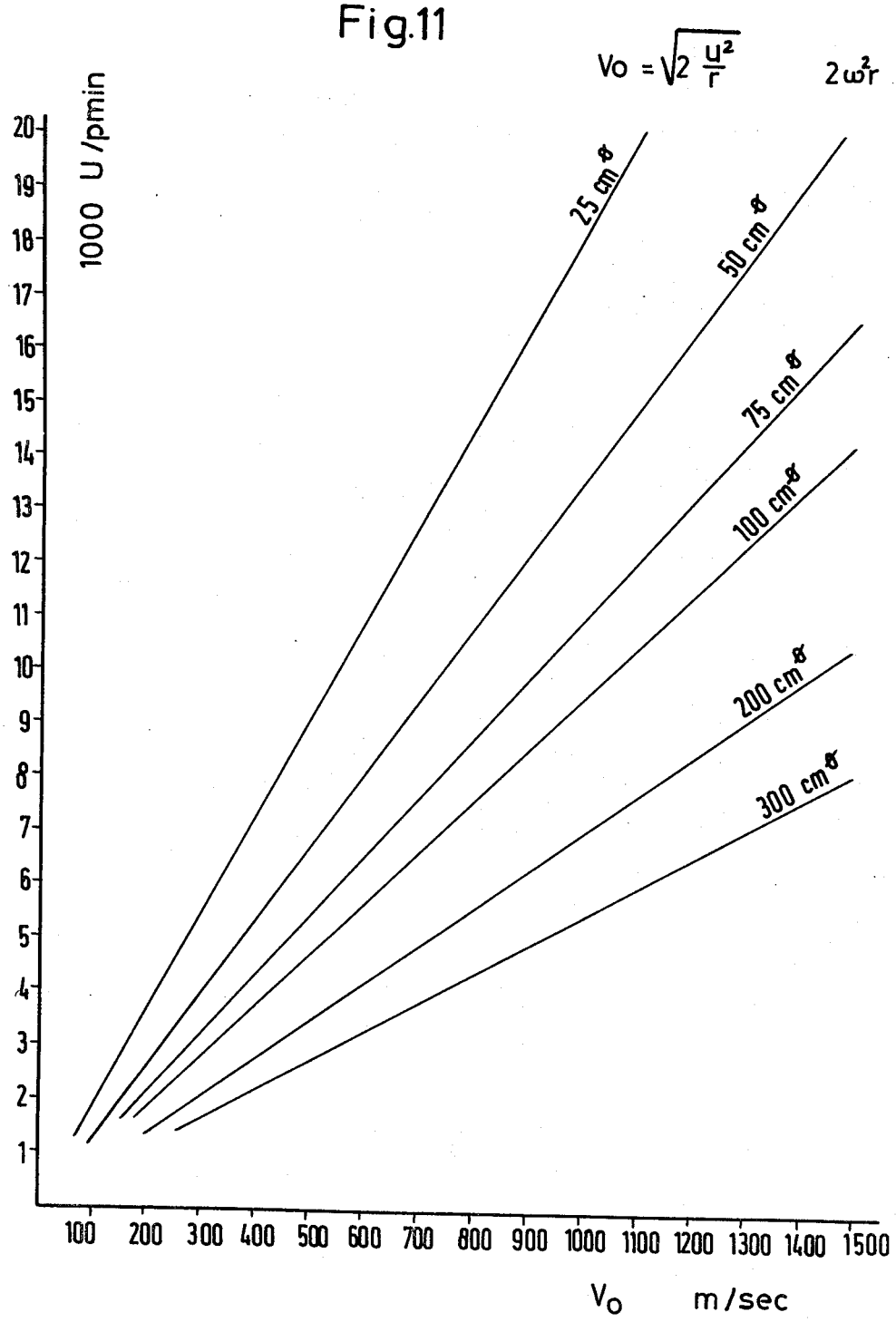
FIG. 11 is a graph.

The values which can be reached in accordance therewith are set forth in the graph given in FIG. 11.

The calculations are based on Vo (initial velocity) measurements which were carried out. They show that the Vo can be determined from the Coriolis acceleration.

The Coriolis acceleration is based on the formula $$b_c=2u\omega \text{ or } b_c=2(u2/v),$$

in which u is the circumferential velocity and $\omega$ the angular velocity.

From this formula, by transformation, it is possible to calculate Vo.

$$Vo=\sqrt{bc}$$

From this in turn, inserting the radius r, there can be obtained the circumferential velocity $$u=\sqrt{\frac{Vo}{2}}\,r$$

in meters/second, and the speed of rotation $$n=u/(d\pi/60)$$

in rpm, and from this the angular velocity $$\omega=(n/30)\pi.$$

In this way, the obtainable launching velocity of the projectile in accordance with the formula $$Vo = \sqrt{2\frac{u^2}{r}} = \sqrt{2\omega^2 \cdot r}\ .$$

The launching velocity is equal to the square root of twice the circumferential velocity squared, divided by radius; or the square root of twice the angular velocity squared, multiplied by the radius.

By way of example the following data are obtained:

TABLE I

| n | ø | r | u | ω | $b_c$ | Vo | increase in % u to Vo |
|---|---|---|---|---|---|---|---|
| 1000 | 0.25 | 0.125 | 13 | 104 | 2704 | 52 | 400 |
| 1000 | 0.50 | 0.25 | 26 | 104 | 5408 | 73 | 282 |
| 1000 | 1.00 | 0.50 | 52 | 104 | 10963 | 104 | 200 |
| 1000 | 1.50 | 0.75 | 78 | 104 | 16328 | 127 | 163 |
| 1000 | 2.00 | 1.00 | 104 | 104 | 21632 | 147 | 140 |

There is thus obtained a doubling of Vo, for instance, merely by doubling the speed of rotation or quadrupling the radius. It is furthermore easy to see that the Coriolis acceleration $b_c$ corresponds to twice the acceleration of linear movements, which are determined after all in accordance with the formula $b=(Vo^2/2)$ and thus corresponds to the mean acceleration. The projectile from the rotary movement with its Coriolis acceleration is subject, upon leaving the tube, to the laws of linear movement and therefore has an acceleration b corresponding to Vo, namely (b/2).

The muzzle velocities reach several times the circumferential velocities, so that it can be seen from these data how the customary, and even substantially higher, projectile velocities can be reached with feasible speed of rotation and structural sizes.

These structural sizes and speeds of rotation also affect the question of caliber in connection with the delivery rate. There result therefrom, for instance, five groups of comparable weapons which are distinguished in Table II below which will hereinafter be explained more fully.

The subdivision of the groups is intended merely as suggestive and is based on the groups which are customary at the present time.

It shows that over the entire range of firearms analogous developments in centrifugal weapons can be carried out. These centrifugal weapons have several important advantages over conventional firearms, which advantage will be compared below.

The most unpleasant and heretofore unsolved secondary phenomena in the case of firearms are the muzzle blast and the muzzle flash or the rocket jet. They prevent any camouflage in battle. As soon as fired, the camouflage previously employed is negated and from then on as a rule the soldier or weapon is difficult to conceal.

For this reason, the elimination of this defect is one of the most urgent problems of military weapon engineering. A favorable solution would enable the weapon and the weapon carrier to approach the enemy more closely undetected and effectively without being recognized upon the opening of fire.

One essential element of military action, namely surprise, is thus in many cases for the first time made possible, or is made more effective. The centrifugal weapons solve this problem with respect to muzzle flash and muzzle blast since they work with little noise, if any. Due to the absence of the development of heat by the propellant charge, light viewing is also made difficult and the life of the barrel is considerably increased.

Centrifugal weapons operate completely without recoil, thus doing away with many problems which are present in the case of firearms. By their entire construction they are imparted high delivery rates which were previously unimaginable. As already described, each tube can launch one projectile for each revolution. Several tubes per device can be used so that, for instance, 10,000 rpm with 3 tubes gives 30,000 rounds a minute. Since one operates without heat or pressure, this high rate can be maintained, subject to the available feed supply, as long as desired without damage to the tubes or weapon. The unusually high sequence of firing requires an enormous feed which is controlled mechanically or by compressed air. Of course, individual fire or slow continuous fire can also be provided, depending on how the projectiles are introduced into the device.

The new system provides in particular also the advantage that cartridges or propellant charges are no longer required. Thus the space and weight requirements for the shooting are limited to the projectiles and thus decreased down by as much as a factor of five.

This naturally furthermore results in very great logistical advantages, particularly also as transportation and storage become safer.

The weapons themselves are reliable and safe, due to their simple construction, and are substantially free of maintenance. Only a very few parts which are subjected to stress are present. Only the motor and the tube disks rotate. Everything else is stationary and is not subjected to stress.

For example, one motor may contain weapons of different caliber on each of its two shaft ends so that one can shoot separately or simultaneously with two different calibers or types of projectiles.

Now there is presented a few comments with regard to type of projectile and selection of caliber. For the experiments, balls were used for reasons of convenience. They have certain inner-ballistic advantages in the case of centrifugal weapons. However, due to the poorer outer ballistics they can possibly be replaced by elongated projectiles. The twist necessary for elongated projectiles can be given by the axial introduction in the case of centrifugal weapons of high speed of rotation, the duration in the axis making the simultaneous driving in the direction of rotation possible. In case of lateral introduction, a twist can be imparted by lateral friction. Furthermore, rifling grooves or corresponding developments can stabilize the projectiles.

With flat disks or plate-shaped bodies the gyroscopic effect can be utilized as with a discus since the path of flight of a discus is far superior to the ballistic curve.

With respect to the selection of the caliber, particular reference should be made to the extremely high delivery rate. As a result, it is probably advisable to shift to smaller calibers since the action of the weapon on the target is increased by the high target striking weights. If, for instance, a shell of a weight of 10 kg strikes a target, it breaks it into pieces which are still effectively blown up within a circumference of about 100 m. This weight is reached, for instance, by a 20 mm centrifugal weapon of about 20,000 rpm within one second. Therefore, a considerable increase of effect in the target region is obtained with the centrifugal weapon if it is held a while on the target.

In the range of smaller calibers, the centrifugal weapon can also be used in fixed position, for instance for the protection of objects, instead of mines. While mines only respond once, this weapon can be used as frequently as desired and is therefore scarcely to be disconnected. It responds again upon each approach.

It can be used as a scatter or spray weapon for all calibers, and in particular also as a high-trajectory weapon which can be set at any angle as well as for fighting from behind coverage and into coverage.

It can be changed from high trajectory to grazing trajectory, as desired, by changing the speeds of rotation.

It can be used as a spray weapon, as well as for the laying of tank, vehicle and anti-personnel mines.

Furthermore, with a suitable arrangement of fuses, use as explosives which detonate upon impact can also be considered.

FIGS. 1 to 5 show the manner of operation of a centrifugal weapon in accordance with the invention. The projectiles are shown as disks, but they may also, in accordance with the invention, have other shapes, such as balls, teardrop shapes, etc. The guide parts and barriers are then adapted to these shapes.

The projectiles 4 are fed through the feed tube 1 and strike in the center against the rotating surface of the centrifugal launcher or carrier. The surface of the carrier is limited by the guide paths 5*a*, 5*b* which carry along the projectiles, which strive to move towards the outside due to the rotation. The guide paths have approximately half the height of the projectile and surround the lower part thereof. The upper part of the projectile is impeded by the spiral barrier 2 from being thrown outward. The barrier urges the projectile between the starting end 6 of the barrier and its finishing end 7, to effect a precise spiral movement which then, at the end 7 of the barrier releases the projectile into the centrifugal launching tube. From this point on, which point can be adjusted depending on the adjustment of the barrier, for aiming, the acceleration of the projectile commences.

The deflection from the axial movement into the radial movement and the release for launching upon aimed ejection take place always in the vicinity of the axis and thus in the region of the smallest forces. As soon as the introduction and aiming have been effected, the acceleration of the projectiles and thus the feeding of energy take place.

By this arrangement, the result is furthermore obtained that in each case only one projectile is in the launching tube during one rotation. The ratio of the weight of the projectile to the centrifugal mass of the centrifugal launcher is such that the energy of rotation of the centrifugal launcher imparts the necessary energy of acceleration to the projectile.

In detail, FIG. 1 shows a cross section A—A through the projectile a which has already been pushed by rotation with the guide path 5*a* against the spiral barrier 2.

FIG. 2 is a top view of the arrangement.

FIG. 3 shows the projectile a just in front of the end 7 of the barrier while the projectile b has already been carried along by the next guide path 5*b*.

Figure 4:
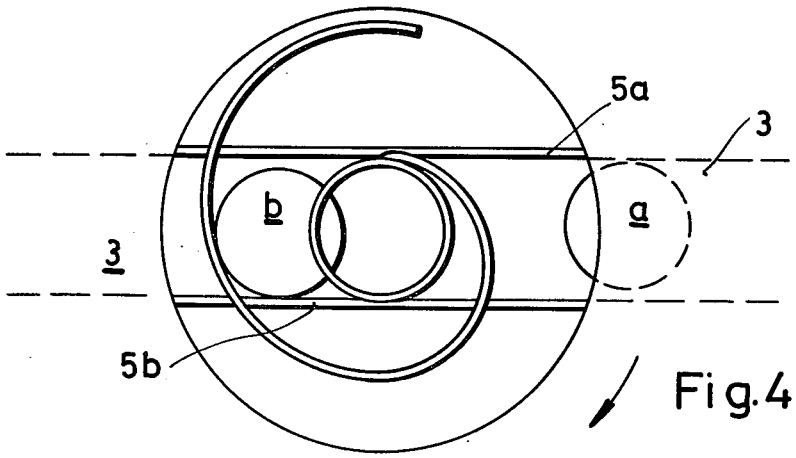

In FIG. 4, the projectile a has already been released by the end 7 of the barrier and entered the launching tube 3. The projectile b is still guided by the spiral barrier 2.

Figure 5:
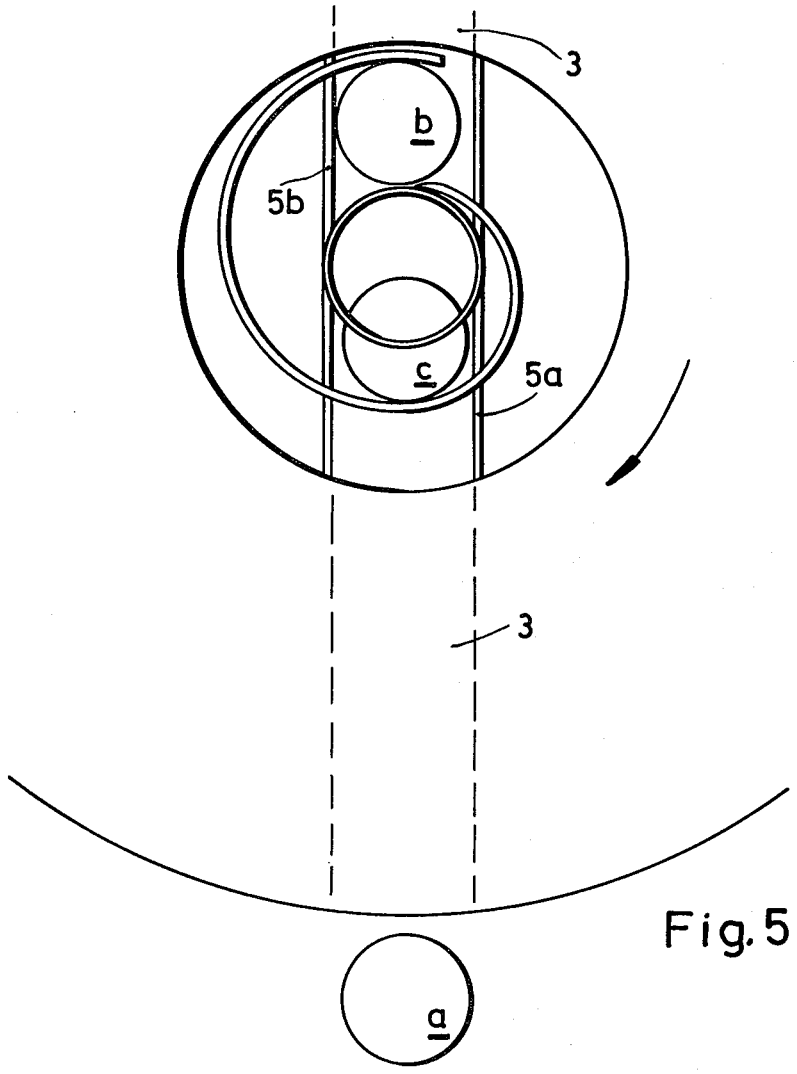

In FIG. 5, the projectile a, after rotation and acceleration, has left the launching tube of the centrifugal launcher and is flying towards its target. The projectile b is now just in front of the end 7 of the barrier, which releases it, after a brief rotation, into the launching tube, while the projectile c is guided by the guide path 5*a* along the spiral barrier.

According to an embodiment of the invention the introduction in the vicinity of the axis is shown in FIG. 6. In this case, the projectiles 9 are introduced laterally through the feed 8 which is adjustable for aiming. The feed channel 10 is beveled at one end so that the carrying along of the projectiles can take place more easily.

The centrifugal launcher 11 rotates about an axis parallel to the feed and carries the foremost projectile along with it in rotation. In this connection, the surface 12 in front of the launcher tube 13 is also beveled so that the projectiles can be easily carried along. As soon as the foremost projectile has been introduced into the centrifugal tube, it can be immediately accelerated for outward projection by the centrifugal force.

Figure 7:
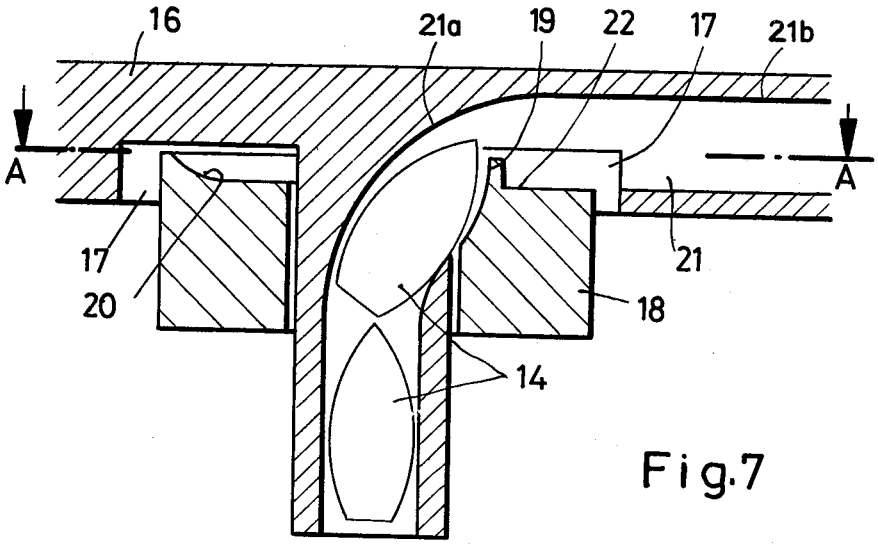
FIG. 7 is a longitudinal section through another embodiment of the invention.
Figure 7A:
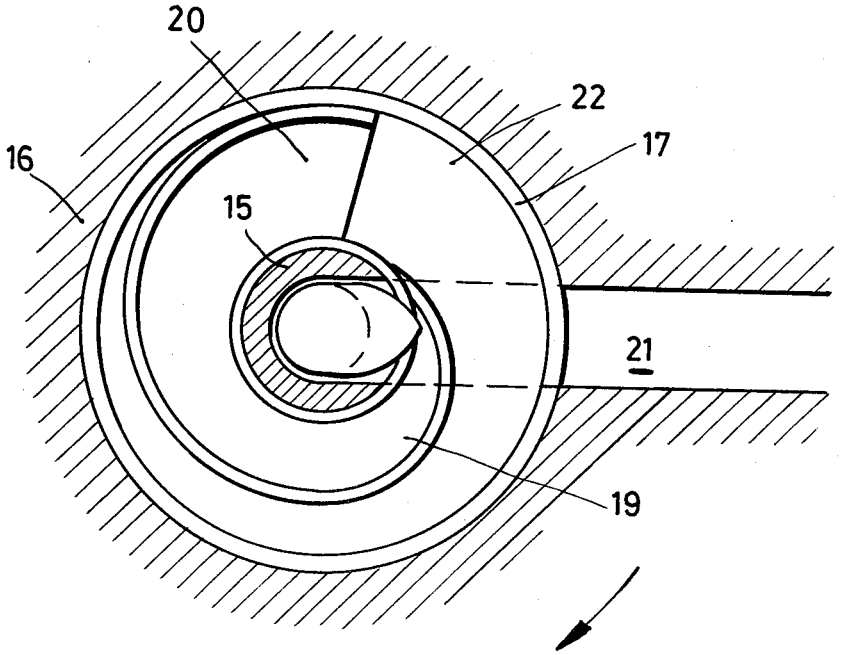
FIG. 7*a* is a horizontal section along the line A—A of FIG. 7.

The deflection of elongated bodies is shown in FIG. 7. In this case, the projectile bodies 14 are introduced along the axis of rotation of the centrifugal launcher 16 and are deflected by guide 15 and barrier 18 into the launching tube 21. The barrier 18 engages into the recess 17, the barrier deflecting the foremost projectile 14 only by further rotation and permitting it to enter the radial axis of the launching tube 21. The barrier 18 is so shaped that its profile at its start 19 changes in such a manner that at the end of the barrier 20 the projectile can enter the launching tube 21. Behind the profiled end 20 of the barrier, the barrier has a stepped depression 22 in order to make it possible for the projectiles to enter the launching tube. The launcher 16 has a guide means 21*a* for guiding the foremost projectile 14 and guide means 21*a* has an open end 21*b* for passage of the projectile 14 into the launching tube 21.

FIGS. 8 to 10 as well as the corresponding cross sections A—A and B—B show the procedure for the introduction of spherical projectiles. In this case, the balls 23 are brought into the feed 24. The foremost ball a is introduced by the rotating centrifugal slinger 25 into the starting end 26 of the spiral barrier which grasps the upper half of the diameter of the ball a and conducts it through the displaceable barrier up to its end 27. Here the spiral barrier 28 is stepped down in such a manner that the ball can enter the lauching tube 29. In this launching tube 29 of the centrifugal slinger 25 it then accelerates to a muzzle velocity which is above the circumferential speed.

FIG. 8 shows the arrangement in a cross section B—B, the ball a already being in the spiral barrier 28. FIG. 9 is a top view while the section A—A of FIG. 10 shows the cut centrifugal slinger 25 from the bottom in order to show what happens, after a rotation of the centrifugal slinger 25 by 90°. In this way the ball a has already moved practically to the end of the spiral barrier 27, while the ball b is introduced into the curve of the spiral barrier. After a brief rotation, the ball a leaves the spiral barrier at the end 27 and enters, for acceleration, into the lauching tube 29.

Figure 12:
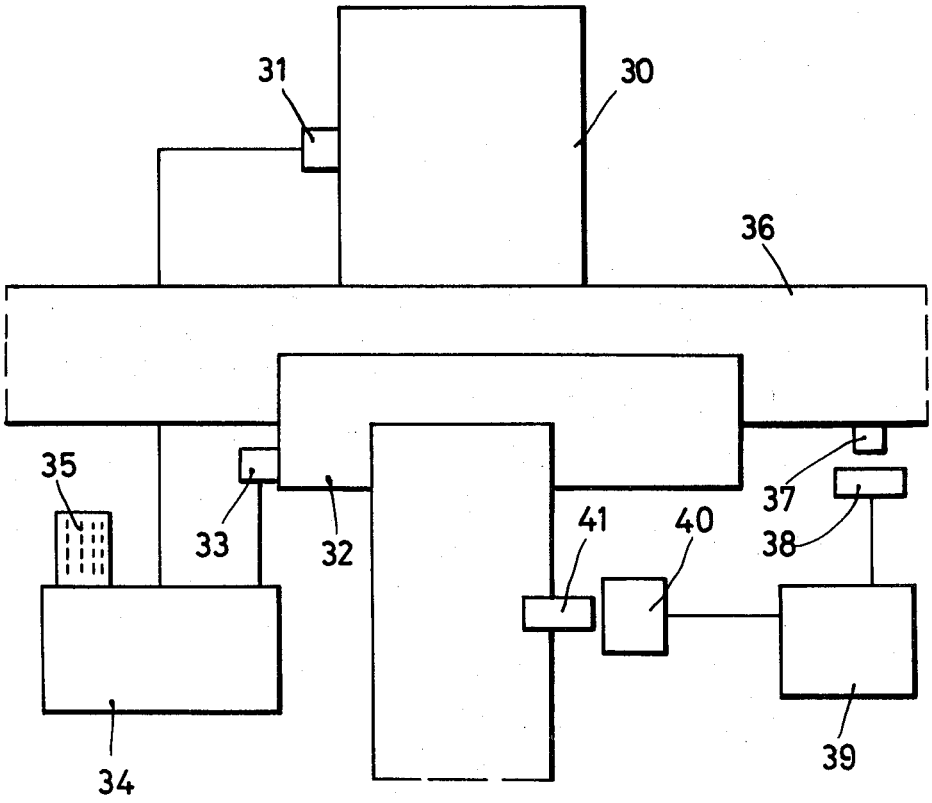
FIG. 12 is a block diagram.

FIG. 12 shows the control of the introduction of the projectiles as well as the control of their departure and aiming.

The drive 30 is brought to the desired uniform or variable speed of rotation by the speed regulator 31. The barrier 32 can be adjusted around its axis to any desired angle. In this way, the feed process is regulated as well as the angle of departure with which the projectile enters the launching tube and thus, in combination with the speed of rotation, the direction of departure. This regulation takes over the adjustment for the departure angle 33.

the vehicle can be fed into the control devices as superimposed program.

The above-discussed Table II shown below will now be described.

TABLE II

| Caliber Ø | Projectile Weight | Vo | Firing Sequence Per Tube min. | Firing Sequence Per Tube sec. | Target Striking Weight Per Tube min. kg | Target Striking Weight Per Tube sec. kg | Tube Lengths Device Ø | Speed of Rotation Range/min. | A = Type of device B = Drive C = Use |
|---|---|---|---|---|---|---|---|---|---|
| | | Classification, Capability, Structural Sizes and Use of Centrifugal Weapons | | | | | | | |
| Centrifugal submachine gun 5–10 | 0.5–4 | 500 | 5000 | 80 | 5 | 0.08 | 250 | 10,000 | A = light portable device<br>B = electric, compressed air |
| | | 1,500 | 20000 | 300 | 50 | 1.0 | 500 | 20,000 | C = same as submachine gun |
| Centrifugal machine gun 10–20 | 4–30 | 700 | 10000 | 160 | 40 | 0.6 | 500 | 10,000 | A = on carrier<br>B = drive by carrier |
| | | 1,500 | 20000 | 330 | 600 | 10.0 | 2000 | 20,000 | C = automobile - to - tank vehicles helicopters - planes - ships same as machine gun |
| Centrifugal cannons 25–60 | 60–900 | 700 | 10000 | 160 | 60 | 10 | 500 | 10,000 | A = as above<br>B = as above |
| | | 1,500 | 20000 | 330 | 1600 | 300 | 2000 | 20,000 | C = as above, also use as anti-aircraft ship's gun/mine layer against infantry and tanks |
| Centrifugal mortars 80–120 | 2 kg | 250 | 2000 | 30 | 4000 | 60 | 500 | 2,000 | A = as above<br>B = as above |
| | 5 kg | 1,000 | 10000 | 160 | 50000 | 800 | 2000 | 10,000 | C = use as mortars, flamethrower oil, smoke, mines against infantry and track-laying vehicles as well as automotive vehicles |
| Centrifugal mine-layer 200–300 | 5–10 kg | 10 | 50 | 1 | 250 | 4 | 1000 | 100 | A = as above<br>B = as above |
| | | 200 | 250 | 4 | 2500 | 40 | 2000 | 1,500 | C = tank mine layer mortar |

Both the speed regulator 31 and the adjustment for the departure angle 33 are controlled by the switch relay 34. The control can be effected individually or coupled, or else by program controller 35. The latter in particular if the desired control is necessary, for instance for the layer of mines, in the case of rapidly moving targets, or in the case of area fire.

The introduction of the projectiles can be controlled individually or for sustained fire. For this purpose, a contact 36 on the arm of the launching tube can so act on the signal generator 37 so that it actuates the switch magnet 40 via the receiver 38 and the control device 39. The magnet opens the outlet 41 at an angle which can be variously adjusted. In this way the introduction of the projectiles can take place precisely at any desired angular positions.

Precise feed procedures are then obtained together with the barriers or else without mechanical barriers, these procedures, by combination with the speed of rotation, achieving exact, aimed departures of the projectiles.

This programming, in combination with the above-indicated possibilities of control, is of interest in particular when the entire device is not fixed in space but is mounted on a vehicle. In this case, road information of

EXPLANATION OF TABLE II

Centrifugal submachine gun: In accordance with the status of the art it is possible to produce a silent submachine gun of very light construction which, by battery or compressed air drive, shoots with high muzzle velocity Vo and delivery rate and is sturdy are reliable. It can operate practically silently and should not be greater than the traditional submachine guns in structural weight.

Centrifugal machine gun: Corresponding to modern machine guns, a rapid fire weapon which is also noiseless or low in noise can be constructed in a somewhat stronger and larger type. The drive could be arranged on the carrier vehicle and be technically connected, for instance via a Jeep motor carriage, scout car helicopter or airplane. The firing speed then corresponds, depending on the function thereof, to up to 50 machine guns of traditional construction. In this way procurement costs and operation, etc. are saved to the same extent.

It would be advisable to equip ground fighter helicopters with this device, they having the device on the bottom thereof and above it a hopper with ammunition having a capacity corresonding to the helicopter. Because of the absence of cartridges, previously unknown amounts of fire power are then available.

Centrifugal cannons: For this shooting of shells of weights of more than 50 g the weapons would have to be developed as cannons. Same type of weapon and drive as in the case of the centrifugal machine guns, although to be sure developed stronger and more stable due to the larger caliber. Nevertheless, simpler, easier, lighter and more dependable in operation than automatic cannons.

The use of this weapon, which can eject per minute up to 20,000 rounds per tube or up to 1600 kg and therefore in the case of double-tubes up to more than 3 tons per minute, must be compared at the target with the weapon effect of the heaviest artillery or concentrated rocket launchers.

In the case of precision targets, a continuous impact action is obtained while in the case of rapidly moving targets such as, for instance, airplanes, the extremely fast sequence of firing forms practically a flying necklace with interprojectiles distances of about 1 m.

In this way it is possible, upon striking, to apply considerable quantities of projectiles within a very short time or by a cascade-like lead action compel the aircraft to fly through this chain. With the dense sequence of shots it is impossible to fly through such barriers without being struck several times.

In the case of area use, a device can offer the clustered weapon effect of several cannons or heavy weapons. To be sure, individual fire and scattered fire can also be utilized.

Centrifugal mortars: With larger caliber the possible speeds of rotation are reduced down to regions in which mortars or heavy howitzers are used and therefore about 300 Vo. In this connection, the weapon can be used as high-angle mortar from ambush or from behind coverage. As a result of the fact that the sequence of rounds is still high, an extremely high weapon effect is again obtained. With increasing speed of rotation, the Vo values are increased to such an extent that either greater ranges are possible than with mortars or, with flatter trajectories, use as howitzers without muzzle blast, etc.

Special possibilities would exist for silent mining of terrain against infantry, vehicles or track-laying vehicles.

Here a very interesting anti-tank possibility affords itself, since the destruction of the weakest point of all vehicles, i.e. the tracks or the chassis, has heretofore been criminally neglected. If one removes the mobility from a tank it is helpless. If this is done during a tank attack in quantity, then the effect on the tank crews is shocking for when the tanks cannot move any longer they can be attacked in various ways.

Furthermore the use of flame-throwing fuels or napalm grenades fired in larger quantities on tanks would be devastating. It is possible to conceive of a viscous mass of flame which develops a great amount of heat and enters into all cracks and depressions. The development of heat causes the crew to emerge, or cables and important parts are burned out.

These agents would naturally have the same effect also against any other attacking body, for instance infantry personnel or automotive vehicles. The centrifugal launcher is also ideal for laying a smokescreen since a thick wall can be laid in a very short time.

In conclusion, reference may again be had to the combination of different calibers in one drive unit having, for instance, two disks whereby, without a large expense or a large amount of space being required, centrifugal guns and cannons or mortars can be used simultaneously or alternately.

THE AMMUNITION FOR CENTRIFUGAL WEAPONS

Since neither pressure nor heat occur for the propulsion of the projectiles, other shapes and types of ammunition can be developed. Explosives are not required in cases in which the explosive is used primarily for fragmenting the projectile at the target. As already described above, the target impact density increased by the high rate can lead to smaller calibers and thus also in many cases to solid projectiles which then assume the splintering effect at the target. In this way, in addition to saving the cost of the catridges there are also saved considerable expenses for the projectiles themselves since they are substantially easier to manufacture.

2. The projectiles can be made of materials which cannot be used in the case of firearms and which are particularly suitable for police use, for instance glass, rubber, plastics, stone, concrete, or other cheap materials, including combinations thereof, and also cast or extruded, ranging up to tungsten with its density and high specific weight.

3. They can contain deformable masses which adapt themselves during their flight to the flow of air and spread apart upon impact, for example similar to mushroom-head projectiles; gel-like fillings can, in case of the use of plastic coverings, flow or spurt apart in order to coat given areas with fire or an irritant (for instance tear gas for police use).

4. Since no powder pressure is produced on the base of the projectile, it is possible, in order to reduce the resistance of the air, to provide the projectiles with one or more boreholes. These boreholes, developed as nozzles, prevent a vacuum at the rear of the projectile and thus improve the resistance and the ballistic properties.

5. The form of projectile can be so developed by this type of drive that inner ballistic and outer ballistic requirements can be satisfied or combined.

6. Since the projectiles do not require any wall-sealing in the barrel and can even have play therein, surface effects can also be applied which are necessary for the external ballistics. Thus riflings can be arranged on the circumference which impart the necessary stability to the projectile.

One particular advantage of a device in accordance with the invention is that, as a result of the variable speed of rotation, not only is a change in range possible but also adaptation to the weight of the projectile. A controlled change of the speed of rotation in accordance with one feature of the invention makes it possible to cover the depth of large areas in accordance with a predetermined pattern or in a statistical dispersion manner without the angle of elevation having to be changed. In order to cover the width of large areas the control of the time of release has a favorable effect, without the direction of shooting having to be changed. Minor corrections on the point of impact can be effected, namely, with a device in accordance with the invention without movement of heavy masses (as in the case of the traditional firearms).

The high delivery rate of a device in accordance with the invention does not lead to an overheating of the barrel as is true of firearms, so that it can be effectively utilized in its entirety. The mechanical stresses on the barrel are also less, so that substantially longer lives of the barrels are made possible, amounting to more than a hundred times the previous figures. Instead of this, the barrels can also be made of cheaper material or in a simpler manner.

I claim:

1. Apparatus for ejecting bodies comprising a carrier driven in rotation about an axis, said carrier having at least one radially extending guide tube, said guide tube having an inlet for receiving bodies to be thrown located approximately at the axis of rotation of the carrier and an outlet at the periphery of the carrier, guide means secured to said carrier for guiding a body in said guide tube as said carrier undergoes rotation, means for feeding bodies to be thrown to said inlet axially along the axis of rotation of said carrier, and a stationary spiral member surrounding the feeding means and cooperating with said guide means for confining the bodies to travel along said spiral member while being carried along in rotation with said carrier via said guide means, said spiral member having an inner inlet end which engages a body supplied by the feeding means to said guide tube and an outer outlet end beyond which the body is free to travel in said guide tube, said guide means having an open end which passes said outlet end of said spiral member as the carrier undergoes rotation such that when the body passes said outlet end of the spiral member the body is free to travel in said guide tube beyond the open end of said guide means and to undergo radial acceleration in said guide tube, said guide means and guide tube being radially aligned so that the body travels radially in said guide tube from said inlet to said outlet while being guided in the radial travel, said guide tube being of a length beyond the guide means to enable the body to undergo radial acceleration in said guide tube and reach muzzle velocity at said outlet of said guide tube which exceeds the circumferential velocity thereat.

2. Apparatus as claimed in claim 1 wherein said guide tube is linear.

3. Apparatus as claimed in claim 1 wherein said guide tube is curved with a radial length of greater than 0.5 m.

4. Apparatus as claimed in claim 1 wherein said spiral member has a length so that only one body at a time is introduced therein per revolution of said carrier.

5. Apparatus as claimed in claim 1 wherein said spiral member extends over more than 360°.

6. Apparatus as claimed in claim 1 wherein said feed means includes a feed tube adjacent said spiral member and wherein said spiral member includes means for separating one body from a stack of bodies contained in said feed tube.

7. Apparatus as claimed in claim 6 wherein the means for separating said one body includes means for effecting a turning movement of said one body in the spiral member in the course of travel therein.

8. Apparatus as claimed in claim 1 wherein the bodies are elongated and said apparatus further comprises means for turning the bodies from an axial orientation into a radial orientation before they pass said outlet end of the spiral member.

9. Apparatus as claimed in claim 1 wherein the bodies to be thrown are flat disc-shaped projectiles having axes of rotation which are transverse to the direction of flight, said feed means introducing the projectiles into the inlet of said spiral member in the vicinity of the axis of rotation of said carrier.

10. Apparatus as claimed in claim 1 comprising means for effecting a twist of the bodies upon introduction thereof at the outlet of said spiral member.

11. Apparatus as claimed in claim 1 wherein the twisting means is constituted by friction means between said carrier and said spiral member.

12. Apparatus as claimed in claim 1 wherein said feed means imparts a gyroscopic movement to the body by rolling thereof in the region of the outlet of the spiral member.

13. Apparatus as claimed in claim 1 wherein said guide means has parallel surfaces which are spaced apart by a distance substantially equal to the width of one of said bodies.

14. Apparatus as claimed in claim 1 wherein said guide means is straight and is proportioned in relation to said bodies to guide a body for substantially only longitudinal movement in said guide means.

15. Apparatus as claimed in claim 1 wherein said outlet end of said spiral member is located at a radial distance from said inlet end approximately equal to the lateral extent of one of said bodies.

16. Apparatus as claimed in claim 15 wherein said carrier is driven at a speed of rotation of at least 100 rpm.

17. Apparatus as claimed in claim 16 wherein said guide tube has a length of at least 0.1 m.

* * * * *